US011877704B2

(12) United States Patent
Pearson

(10) Patent No.: US 11,877,704 B2
(45) Date of Patent: Jan. 23, 2024

(54) RETRACTABLE SHOWER FLOOR

(71) Applicant: Brian K. Pearson, LLC., Toccoa, GA (US)

(72) Inventor: Brian K. Pearson, Toccoa, GA (US)

(73) Assignee: BRIAN K. PEARSON, LLC., Toccoa, GA (US)

( * ) Notice: Subject to any disclaimer, the term of this patent is extended or adjusted under 35 U.S.C. 154(b) by 0 days.

(21) Appl. No.: 17/813,030

(22) Filed: Jul. 16, 2022

(65) Prior Publication Data

US 2023/0010114 A1 Jan. 12, 2023

Related U.S. Application Data

(63) Continuation of application No. 17/805,393, filed on Jun. 3, 2022, now abandoned.

(60) Provisional application No. 63/218,755, filed on Jul. 6, 2021.

(51) Int. Cl.
*A47K 3/07* (2006.01)
*A47K 3/14* (2006.01)

(52) U.S. Cl.
CPC . *A47K 3/07* (2013.01); *A47K 3/14* (2013.01)

(58) Field of Classification Search
CPC ..... E04H 4/06; E04H 4/065; E04H 4/082; E04H 4/086; E04H 4/088; E06B 9/0646; E06B 9/0638; E06B 9/0607; E06B 9/04; E06B 9/115; A47K 3/12; A47K 3/122; A47K 3/125; A47K 3/127; A47K 3/001
See application file for complete search history.

(56) References Cited

U.S. PATENT DOCUMENTS 8,646,120 B2 * 2/2014 Schueler ..... A47K 3/04 4/584
2007/0256797 A1 * 11/2007 Orton ..... E05F 15/681 160/188
2013/0098276 A1 * 4/2013 Trinko ..... A61G 13/105 108/33
2016/0220077 A1 * 8/2016 Blake ..... A47K 3/281
2018/0125228 A1 * 5/2018 Porter ..... H05K 5/0017

FOREIGN PATENT DOCUMENTS

ES 2526153 A1 * 1/2015 ..... A47K 3/001

OTHER PUBLICATIONS

Machine Translation of ES2526153, retrieved Dec. 13, 2022 (Year: 2022).*

* cited by examiner

*Primary Examiner* — Janie M Loeppke
(74) *Attorney, Agent, or Firm* — Perilla Knox & Hildebrandt LLP; Thomas B. Hildebrandt

(57) ABSTRACT

A retractable shower floor in various embodiments is convertible between an operating position and a retracted position. The retractable shower floor in the operating position spans across a bathtub and facilitates support of at least one person and drainage of water through the retractable shower floor and into the bathtub underneath. The retractable shower floor in the retracted position facilitates unobstructed use of the bathtub.

19 Claims, 8 Drawing Sheets

RETRACTABLE SHOWER FLOOR

CROSS REFERENCE TO RELATED APPLICATIONS

This application is a continuation of U.S. patent application Ser. No. 17/805,393, entitled, "RETRACTABLE SHOWER FLOOR," filed on Jun. 3, 2022, which claims the benefit of U.S. Provisional Application No. 63/218,755, entitled, "RETRACTABLE SHOWER FLOOR," filed Jul. 6, 2021, the entire disclosure of which application is hereby incorporated herein by reference.

BACKGROUND

Residential full bathrooms may have a variety of configurations of bathtubs and showers. Some bathrooms may have a combined bathtub and shower, where a person may stand in the bathtub to take a shower. Other bathrooms may have dedicated shower stalls instead of or in addition to bathtubs. Shower stalls are typically easier to enter for individuals with disabilities or reduced mobility, as they have curbs that are much lower than the edge of the bathtub. In some cases, shower stalls may be designed without any curbs at all. Shower stalls may offer an additional advantage of a slip-resistant floor, as opposed to the typically smooth surface of a bathtub.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
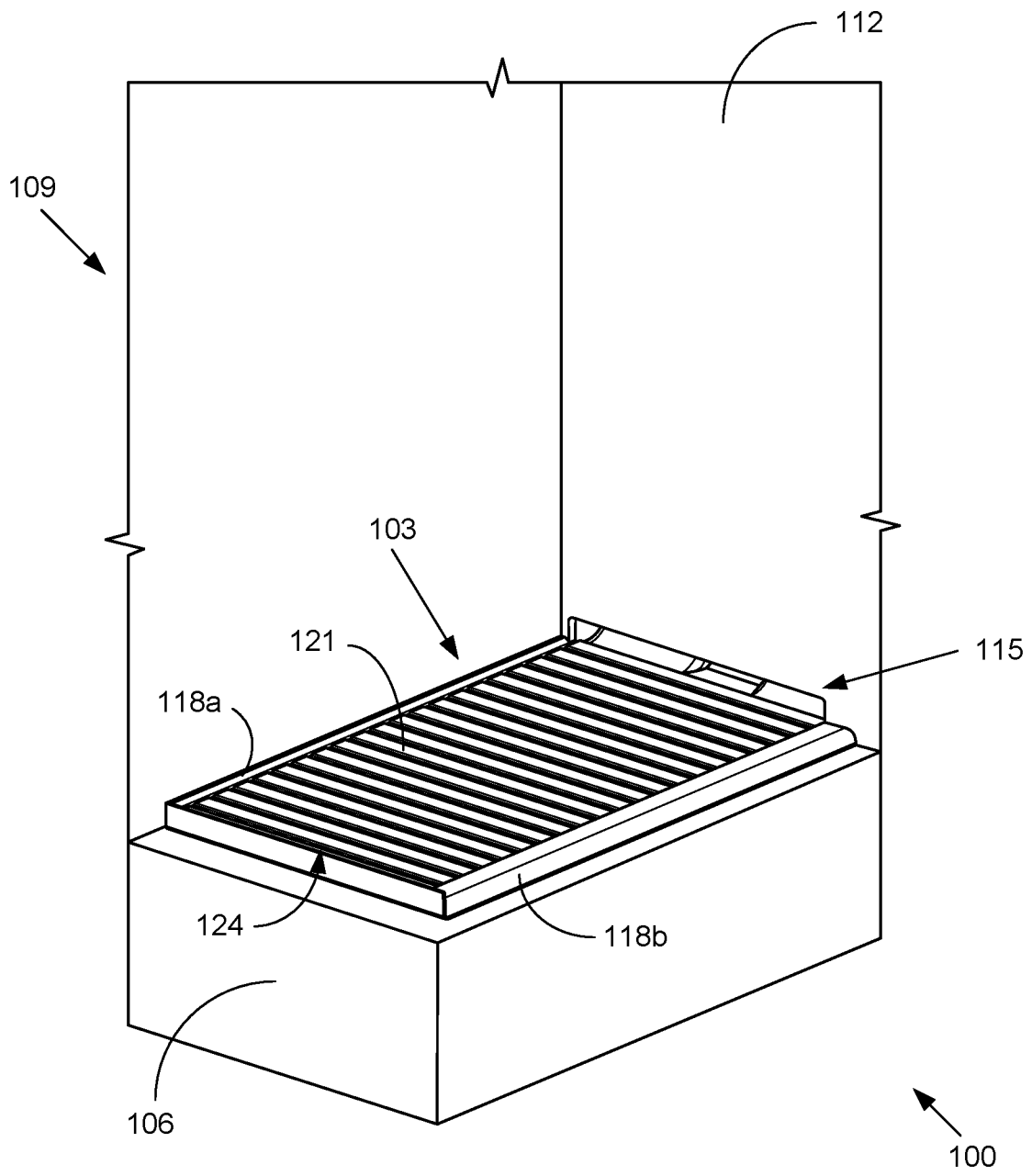
FIG. 1 depicts a perspective view of a retractable shower floor system in an operating position according to one embodiment.

The present disclosure relates to a retractable shower floor that allows a bathtub to be covered and used as a walk-in shower. While there are advantages to having dedicated shower stalls, they can take up considerable floor area in addition to a bathtub. Some bathrooms may omit bathtubs entirely to save floor area, but bathtubs may be preferred to showers by some individuals (e.g., for soaking and relaxation), and bathtubs can be a necessity for bathing small children. Thus, a bathroom should ideally be equipped with both a bathtub and a shower, but limited space often prevents such a configuration.

Various embodiments of the present disclosure introduce a retractable shower floor that allows a bathtub to be covered over with the shower floor and used as a walk-in shower. The bathtub may be recessed or non-recessed. The bathtub may correspond to a standard drop-in bathtub, a deep soaker tub, a garden tub, or other types of bathtubs. In some examples, the bathtub may be a jetted tub. The configuration may be 32 inches wide by 72 inches long, 36 inches wide by 60 inches long, 48 inches wide by 72 inches long, or any other dimension for a bathtub as desired. The bathtub may be acrylic fiberglass, plastic, steel, aluminum, cast iron, or another material.

In a house having a concrete slab on grade, the earth in area for the bathtub in bathroom may be excavated deeper to accommodate the recessed tub. Bathrooms over crawlspaces may be framed so as to have a drop down into the crawlspace to accommodate the recessed bathtub. Bathrooms over lower floors may have the ceiling height for the lower floor under the bathtub reduced to accommodate the recessed bathtub from above. For mobile homes, the bathtub may be recessed into the underbelly or crawlspace of the mobile home. Wood or metal framework may be provided in order to support the considerable weight of the bathtub loaded with water, where the weight may be transferred from the center to the framework rather than the edge, particularly with acrylic bathtubs.

Generally, a gravity drain system will be used with the recessed bathtub, though this would require a connection to drainage plumbing that is under the level of the bottom of the bathtub. In some cases, particularly in retrofits of existing structures, the bathtub drain may be below the structure's drainage plumbing. In such cases, the bathtub may be equipped with an ejection pump to discharge the water draining from the bathtub drain or overflow to the structure's drain plumbing above.

The shower floor is configured to fit over the opening of the bathtub, thereby concealing the bathtub, and to support the weight of one or more people standing upon it. Further, the shower floor is configured to allow water to drain through it by way of one or more openings in the shower floor. Thus, the water passes through the shower floor to the bathtub below, where the water exits the bathtub by the bathtub drain.

The shower floor may be implemented in various ways in various embodiments. In one embodiment, the shower floor is concealed behind a surface of the shower stall and rolls out on a track over the bathtub to cover the bathtub. For example, the shower floor may be constructed of half-inch plastic rolling on half-inch stainless steel rods spaced three inches apart. Each rod may have plastic caster wheels one inch in diameter under the floor. In another example, the shower floor is constructed of hollow U-shaped aluminum elongated elements. In another embodiment, the shower floor opens accordion style from the side wall to cover the bathtub. In another embodiment, the shower floor folds down from the side wall to cover the bathtub. The shower floor may be stored at a short side wall or a long side wall of the shower stall.

In various embodiments, the shower floor may be constructed of stainless steel, aluminum, polymers, porcelain, and/or other components that provide structural strength to support the weight of one or more individuals and also to resist corrosion from water contact. The surface of the floor may have a rough or otherwise slip resistant surface.

A lip structure may surround the bathtub and the shower floor so as to direct the water into the bathtub rather than to exit onto the floor. A functional shower curb may be present or absent if desired. However, it is anticipated that the height of a shower curb will be far less than the height of the edge of the bathtub, making it easier for individuals with mobility issues to gain access to the shower.

The retraction and/or extension of the shower floor may be manual or automatic in various embodiments. For example, a motor may extend or retract a push rod connected to the shower floor, with actuation of the motor in one direction or another causing the push rod to extend or retract the shower floor. The push rod in one example may be rolled up onto or extended from a reel by the motor, while in another example the push rod may be threaded and actuated via a screw action by the motor. Alternatively, the motor may cause the shower floor to extend out or retract in by driving a belt that attaches to the shower floor.

FIG. 1 depicts a perspective view of a retractable shower floor system 100 in an operating position according to one embodiment. The retractable shower floor system 100 includes a retractable shower floor 103 that, when in an operating position as shown, overlays the top of a bathtub 106. The bathtub 106 may be installed to rest upon a floor level in a structure, or the bathtub 106 may be installed below a floor level in a structure such that a top of the bathtub 106 approximately equals the floor level. The retractable shower floor system 100 may incorporate a bathtub surround 109 having one or more walls 112. The bathtub surround 109 may be constructed of tile, glass, fiberglass, acrylic, or another material. One of the walls 112 of the bathtub surround 109 may have an opening 115 at or near the bottom of the wall 112 through which the retractable shower floor 103 may be retracted behind the wall 112 when the retractable shower floor 103 is in a retracted position.

The retractable shower floor 103 may have a plurality of rails 118*a* and 118*b* that support and guide a plurality of elongated elements 121 of the retractable shower floor 103. The rails 118 may include a track in a horizontal plane above or on top of the bathtub 106. The elongated elements 121 are formed of a rigid material and configured to support the weight of one or more persons showering without permanent deformation and to allow water to drain into the bathtub 106 underneath. In one example, the elongated elements 121 are formed of aluminum slats being substantially in an inverted U-shape in cross-section. Individual elongated elements 121 may have a first respective roller to move along a first track or rail 118*a* and a second respective roller to move along a second track or rail 118*b*. A space between adjacent elongated elements 121 may allow the adjacent elements 121 to be rotated 90 degrees along a radius in order to fit behind the wall 112. The space may also allow water emitted from a shower to drain through the retractable shower floor 103 into the bathtub 106 underneath. In other examples, the retractable shower floor 103 may have holes in the elongated elements 121 that allow water to pass through and not collect on top of the retractable shower floor 103. Adjacent elongated elements 121 may be attached to one another by way of one or more hinges 124. The hinges 124 may allow the elongated elements 121 to rotate up or down to facilitate the 90 degree rotation of the elongated elements 121 along the radius.

Figure 2:
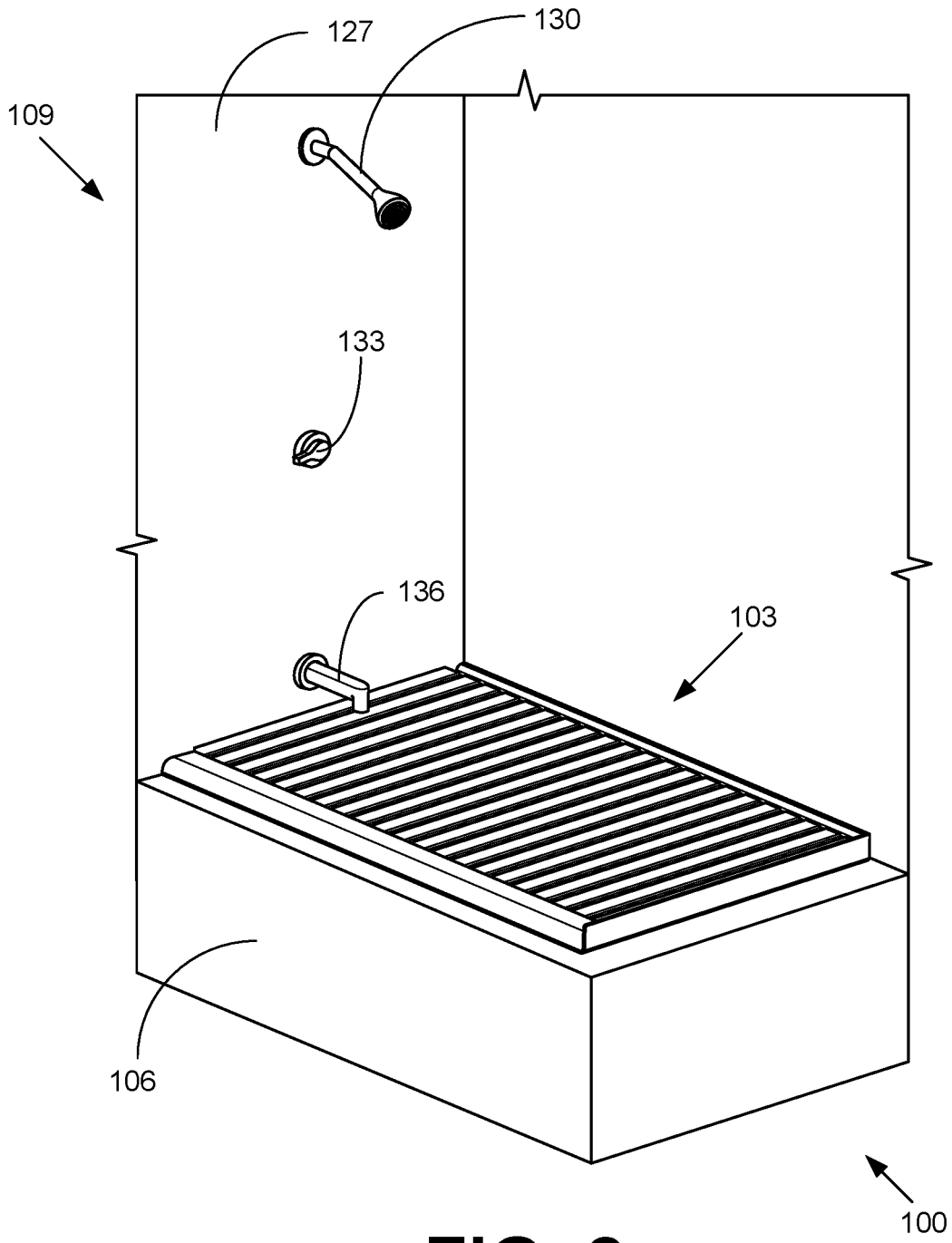
FIG. 2 shows a perspective view of the retractable shower floor system according to the embodiment of FIG. 1, but from an opposite angle.

FIG. 2 shows a perspective view of the retractable shower floor system 100 according to the embodiment of FIG. 1, but from an opposite angle. From this angle, an opposite wall 127 is seen, having various plumbing fixtures, such as a shower head 130, operational controls 133, and a tub spout 136. The shower head 130 is configured to emit water onto a person standing on top of the retractable shower floor 103. The water passes through the retractable shower floor 103 into the bathtub 106 underneath and then drains out via the bathtub 106. The tub spout 136 emits water into the bathtub 106 and is usually operated when the retractable shower floor 103 is in a retracted position, or at least retracted sufficiently to allow the water to pass directly from the tub spout 136 into the bathtub 106.

The operational controls 133 may enable the water to be turned on and off, the water temperature to be adjusted, and in some cases select between the shower head 130 and the tub spout 136. In other cases, the tub spout 136 may include a control to divert water to the shower head 130 instead of the tub spout 136. Other plumbing fixtures may be present and controlled by the operational controls 133, such as alternative shower heads (e.g., an overhead rain can) and body sprayers. The operational controls 133 may also include switches, buttons, etc., that can control the operation of a motor that retracts or extends the retractable shower floor 103. In some cases, operation of the motor may be controlled by a remote control or by fixed controls mounted in a different location.

Figure 3:
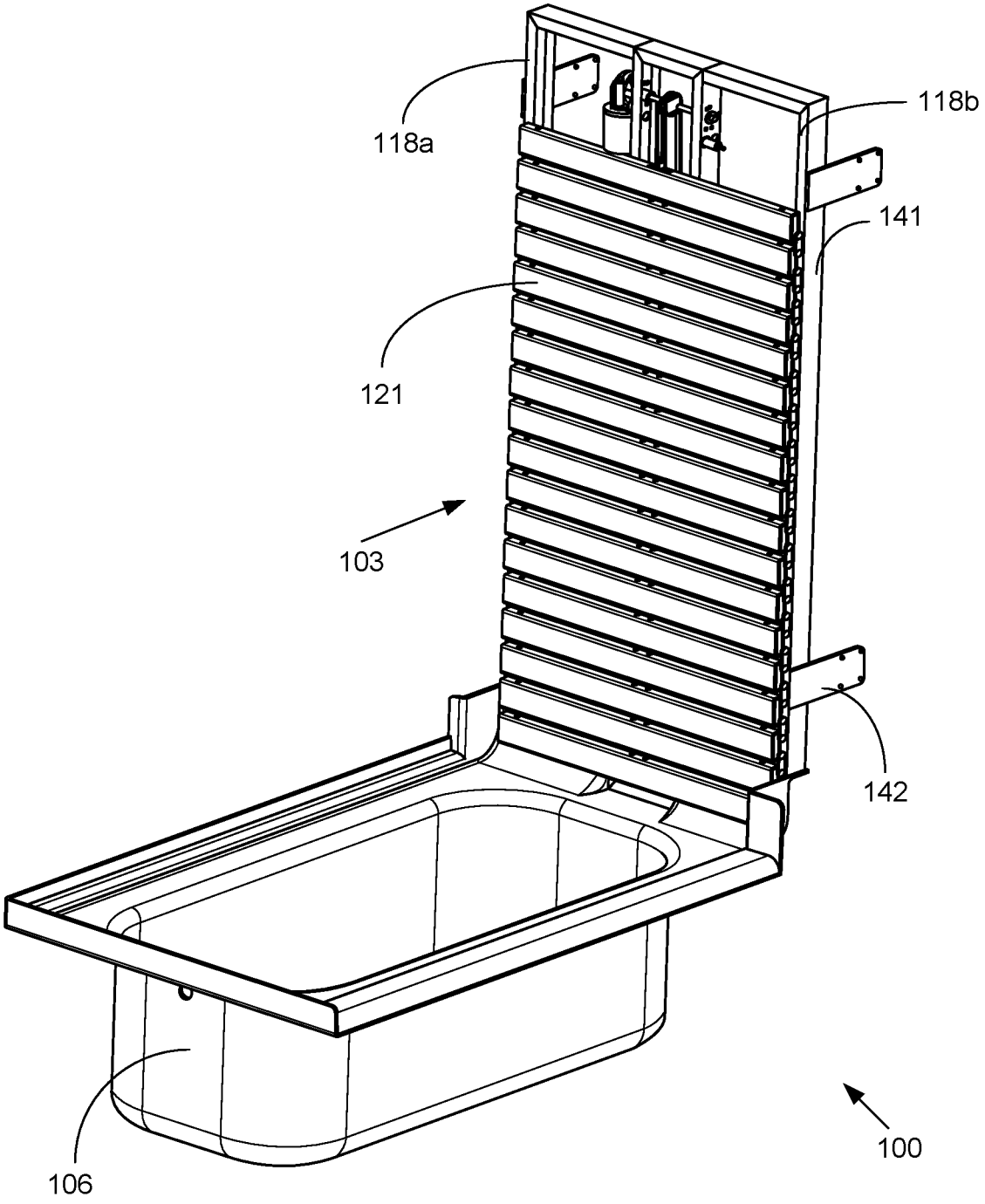
FIG. 3 depicts a perspective view of a retractable shower floor system in a retracted position according to one embodiment.

FIG. 3 depicts a perspective view of a retractable shower floor system 100 in a retracted position according to one embodiment. The retractable shower floor system 100 in FIG. 3 is shown without a surround 109 (FIG. 1) to illustrate the components of the retractable shower floor system 100 behind the wall 112 (FIG. 1) when the retractable shower floor 103 is in a retracted position. A frame 141 extends upwardly above the bathtub 106 into which the retractable shower floor 103 retracts into the retracted position. The frame 141 comprises mounting hardware 142, such as a plurality of mounting plates that extend outwardly from the frame 141 behind the wall 112. In this example, mounting hardware 142 is shown that enables the retractable shower floor system 100 to be mounted to framing members behind the wall 112. The mounting hardware 142 may comprise nailing plates, steel connectors, straps, etc. As shown, when the retractable shower floor 103 is in the retracted position, the elongated elements 121 may be entirely hidden behind the wall 112. In this view, the rails 118*a*, 118*b* that curve according to a 90 degree radius and extend upwardly behind the wall 112 can be seen.

Figure 4:
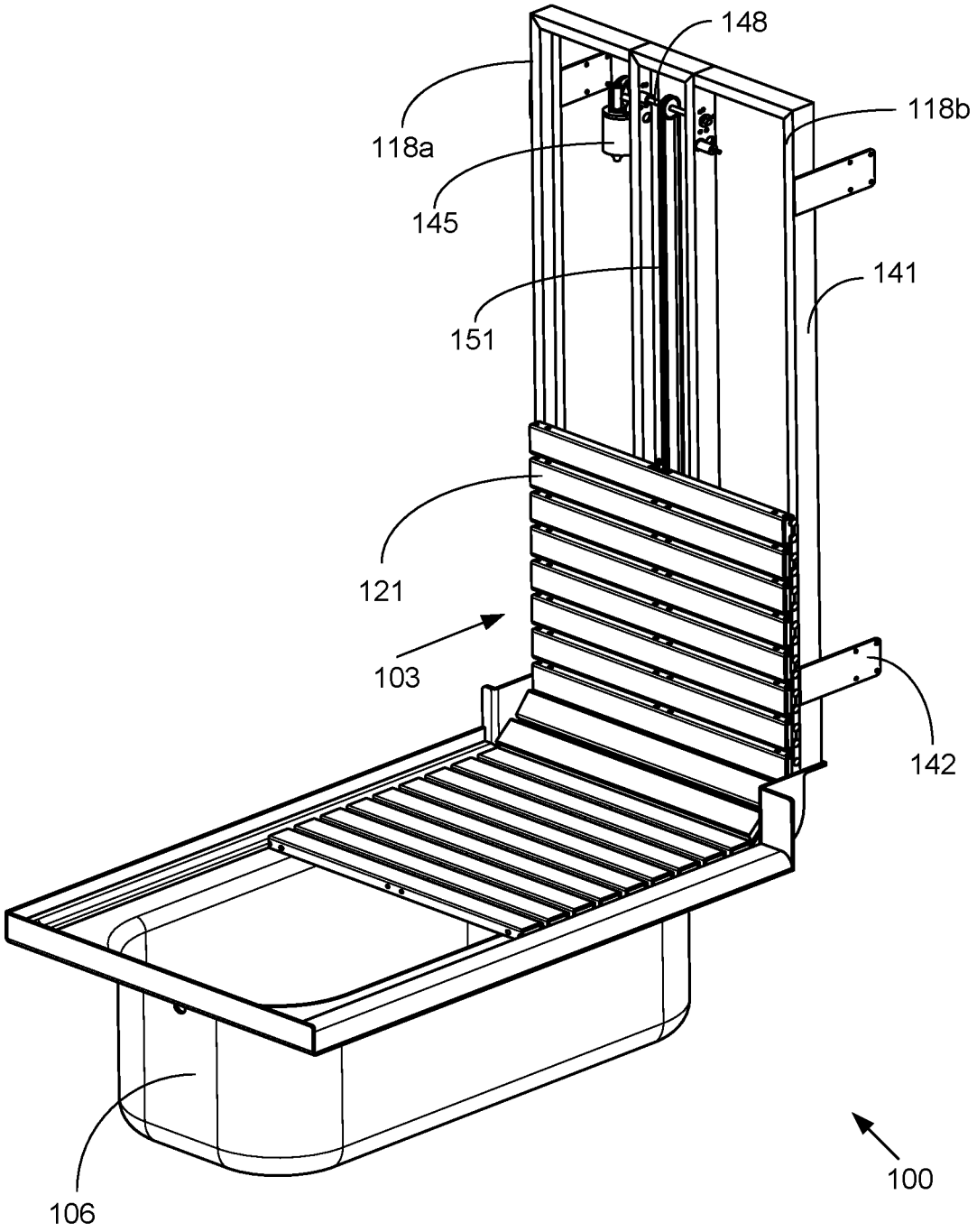
FIG. 4 depicts a perspective view of a retractable shower floor system approximately midway between a retracted position and an operating position according to one embodiment.

FIG. 4 depicts a perspective view of a retractable shower floor system 100 approximately midway between a retracted position and an operating position according to one embodiment. The retractable shower floor system 100 in FIG. 4 is shown without a surround 109 (FIG. 1) to illustrate the components of the retractable shower floor system 100 behind the wall 112 (FIG. 1).

More clearly visible in FIG. 4 is a motor 145, a drive mechanism 148, and a drive belt 151, that are used to automatically move the retractable shower floor 103 between the retracted position and the operating position. The motor 145 (e.g., a ⅓ horsepower (HP) motor, a ½ HP motor, etc.) is activated by a user to actuate the drive mechanism 148. The drive mechanism 148 may include gears, pulleys, etc., to transfer the motion of the motor 145 to move a drive belt 151. The drive belt is attached to the retractable shower floor 103. The drive mechanism 148 may include a reversing function that enables the retractable shower floor 103 to be brought in or out. Other drive mechanisms 148 that do not use a drive belt 151 may be used in other embodiments. Also, some embodiments may omit a powered mechanism for retracting and advancing the retractable shower floor 103, instead relying upon one or more manually actuated handles that enable a user to pull the retractable shower floor 103 out from a retracted position or to push the retractable shower floor 103 into the retracted position.

Figure 5:
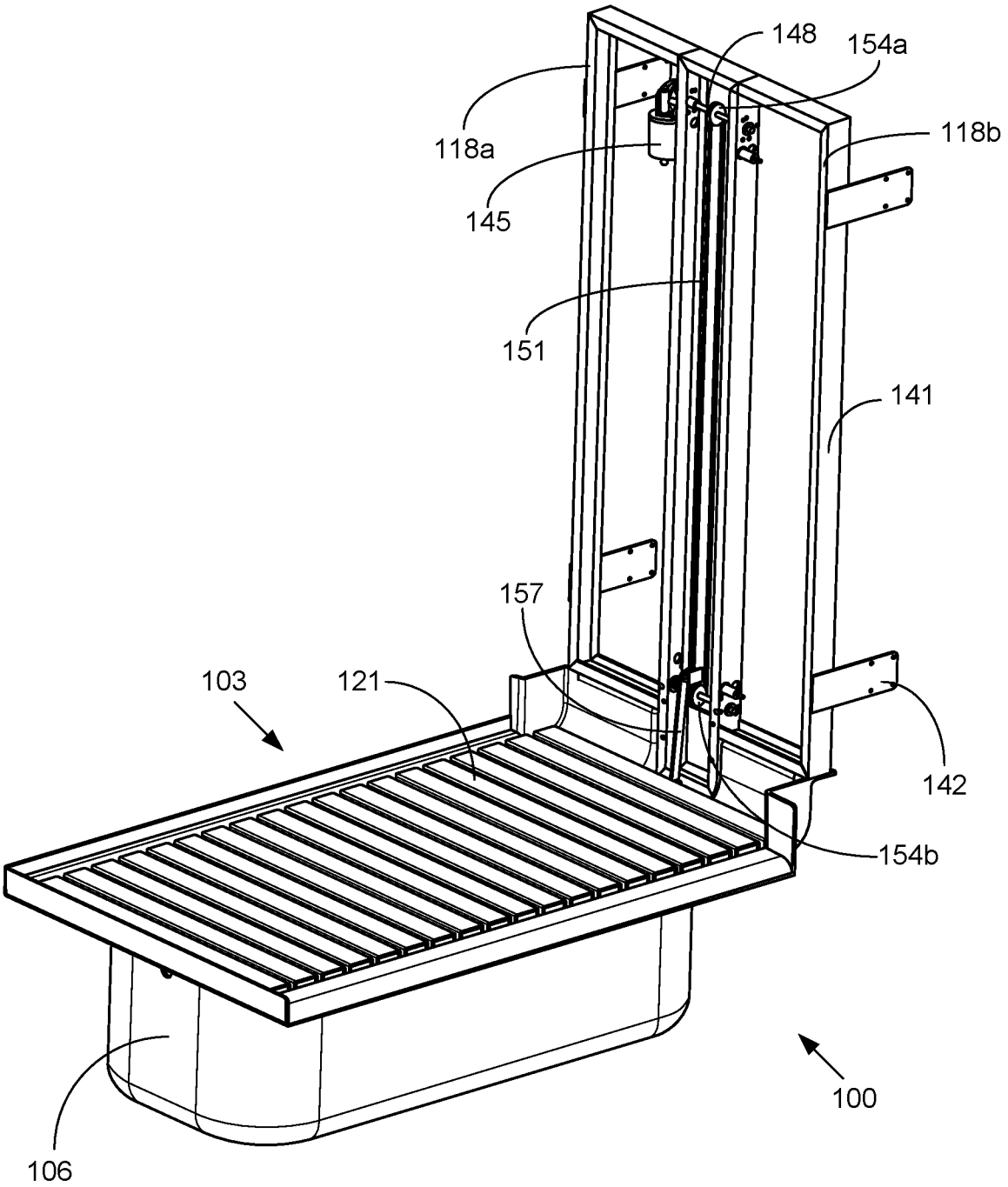
FIG. 5 depicts a perspective view of a retractable shower floor system in an operating position but shown without a surround according to one embodiment.

FIG. 5 depicts a perspective view of a retractable shower floor system 100 in an operating position but shown without a surround 109 (FIG. 1) according to one embodiment. The retractable shower floor system 100 in FIG. 4 is shown without the surround 109 to illustrate the components of the retractable shower floor system 100 behind the wall 112 (FIG. 1). In FIG. 5, the entire length of the drive belt 151 is shown, which is looped around an upper pulley 154*a* and a lower pulley 154*b*. The upper pulley 154*a* is coupled to the drive mechanism 154 to transfer motion to the drive belt 151. The retractable shower floor 103 is attached to the drive belt 151 via an attachment 157. The attachment 157 may comprise a bar that extends outwardly from the drive belt 151 in a longitudinal direction and attached to the retractable shower floor 103 at substantially a midpoint of a width of an upper one of the plurality of elongated elements 121.

Figure 6:
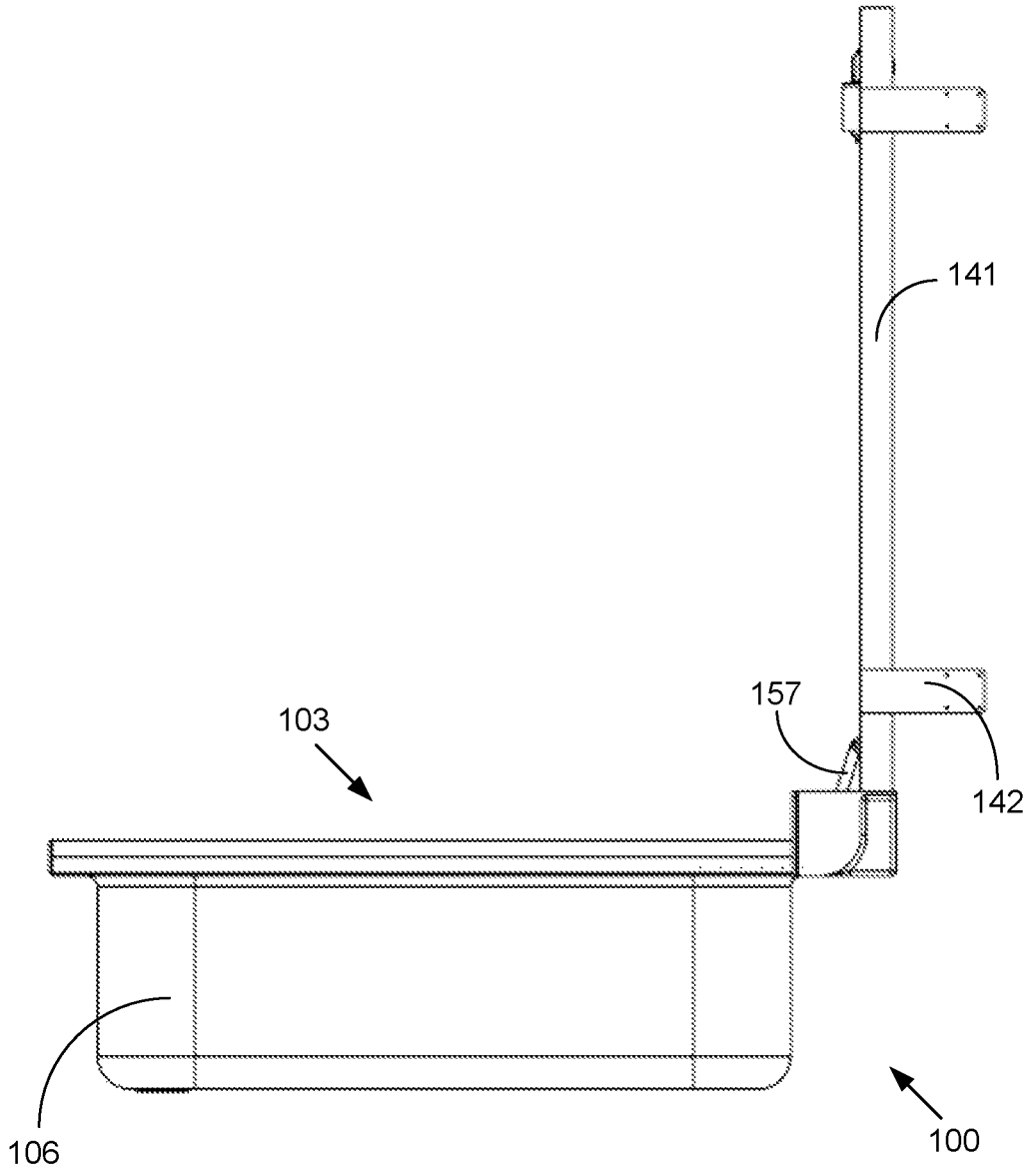
FIG. 6 shows a front side view of the retractable shower floor system according to one embodiment.

FIG. 6 shows a front side view of the retractable shower floor system 100 according to one embodiment. In FIG. 6, the retractable shower floor 103 is in the operating position.

Figure 7:
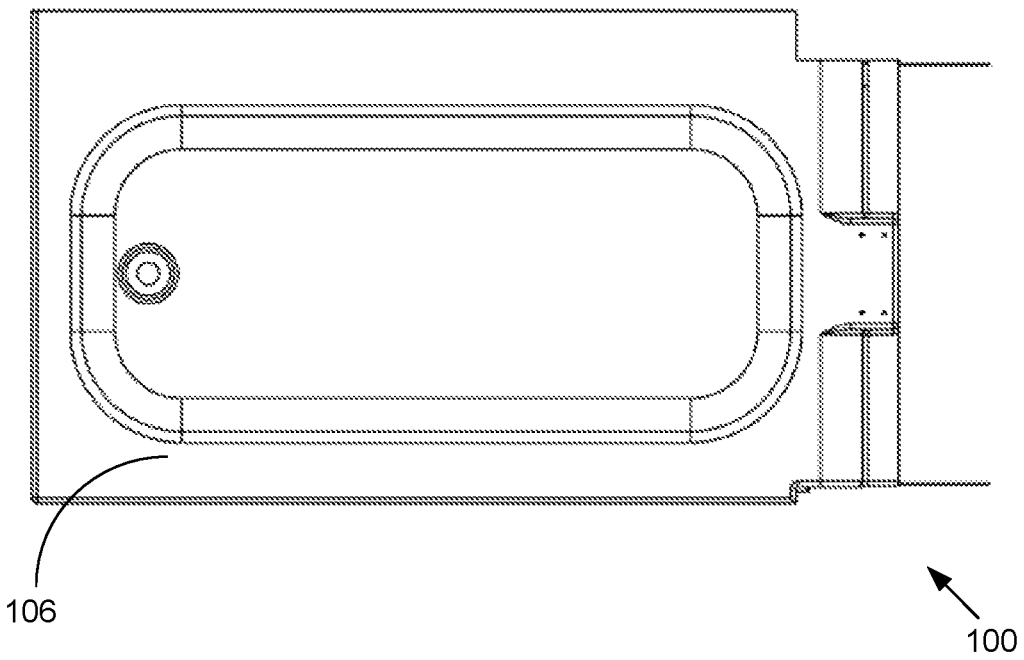
FIG. 7 shows a top view of the retractable shower floor system according to one embodiment.

FIG. 7 shows a top view of the retractable shower floor system 100 according to one embodiment. FIG. 7 shows the interior of the bathtub 106. In FIG. 7, the retractable shower floor 103 (FIG. 1) is omitted for purposes of illustration.

Figure 8:
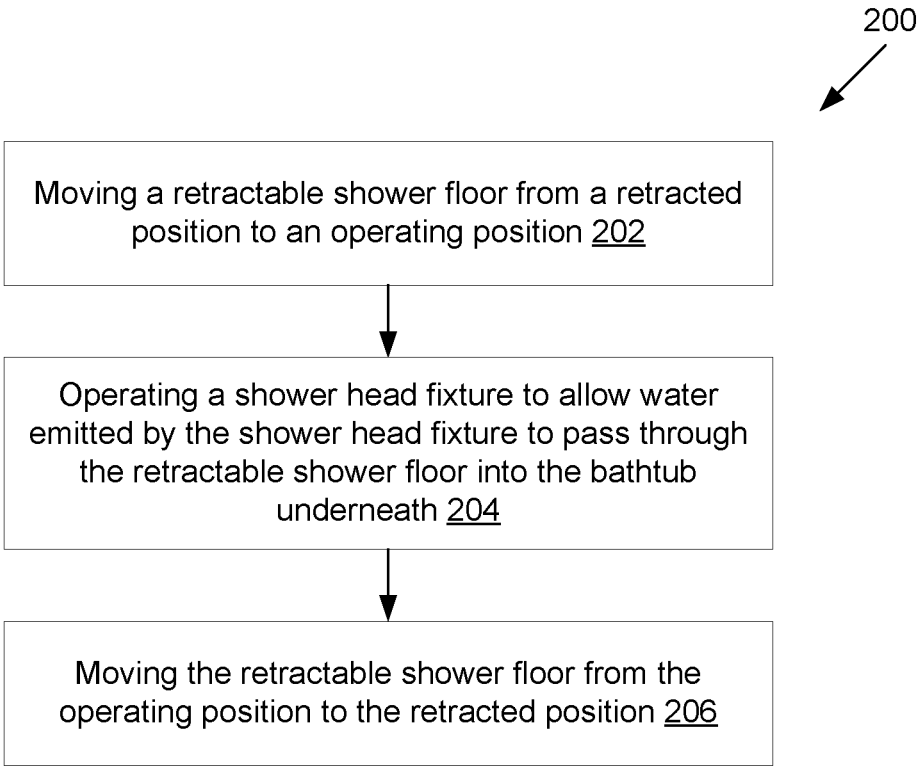
FIG. 8 is an example flowchart depicting steps of a method for using a convertible tub/shower such as the retractable shower floor system of FIG. 1.

FIG. 8 is an example flowchart 200 depicting steps of a method for using a convertible tub/shower such as the retractable shower floor system 100 (FIG. 1). The flowchart 200 is merely one example, and the steps of the flowchart 200 may be reordered in other examples, while additional steps may be present and existing steps may be omitted.

Beginning with 202, a user moves a retractable shower floor 103 (FIG. 1) from a retracted position to an operating position. The retractable floor covers a top of a bathtub 106 (FIG. 1) when in the operating position. In one embodiment, moving the retractable shower floor 103 may include activating a switch causing a motor 145 (FIG. 4) to move the retractable shower floor 103 out from behind a surround 109 (FIG. 1) of the bathtub 106 along a pair of tracks or rails 118 (FIG. 1) through an opening 115 (FIG. 1) in the surround 109. In another embodiment, moving the retractable shower floor 103 may include manually pulling the retractable shower floor 103 out via a handle along a pair of tracks or rails 118 from behind a surround 109 of the bathtub 106 through an opening 115 in the surround 109.

At 204, a user operates a shower head fixture 130 (FIG. 2) to allow water emitted by the shower head fixture 130 to pass through the retractable shower floor 103 into the bathtub 106 underneath, for example, by way of the openings between the elongated elements 121 (FIG. 1).

At 206, a user moves the retractable shower floor 103 from the operating position to the retracted position. In so doing, the retractable shower floor 103 is retracted through an opening 115 in a surround 109 of the bathtub 106 so that the retractable shower floor 103 in the retracted position is contained behind the surround 109 of the bathtub 106.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A retractable shower floor system, comprising:

a bathtub;

a bathtub surround having at least two walls, one wall of the bathtub surround including an opening at or near a bottom of the one wall;

a pair of tracks that extend over two sides of the bathtub into the opening and behind the one wall;

a retractable shower floor that is convertible between an operating position in which the retractable shower floor is horizontal and a retracted position in which the retractable shower floor is vertical, the retractable shower floor comprising a plurality of elongated elements that move along and span across the pair of tracks;

a motor coupled to a drive mechanism that is configured to transfer motion of the motor to a looped drive belt spanning an upper pulley and a lower pulley, the retractable shower floor comprising an attachment to the looped drive belt, the attachment comprising a bar extending outwardly from the looped drive belt in a longitudinal direction and attached to the retractable shower floor at substantially a midpoint of a width of an upper one of the plurality of elongated elements, wherein motion of the looped drive belt in a first direction causes the retractable shower floor to retract toward the retracted position, and motion of the looped drive belt in a second direction causes the retractable shower floor to extend toward the operating position; and wherein the retractable shower floor in the operating position spans across the bathtub and facilitates support of at least one person and drainage of water through the retractable shower floor and into the bathtub underneath, and the retractable shower floor in the retracted position facilitates unobstructed use of the bathtub.

2. The retractable shower floor system of claim 1, wherein individual ones of the plurality of elongated elements comprise a hollow aluminum slat.

3. The retractable shower floor system of claim 1, wherein adjacent ones of the plurality of elongated elements are connected by at least one hinge.

4. The retractable shower floor system of claim 1, further comprising a frame that extends upwardly above the bathtub into which the retractable shower floor retracts into the retracted position, the frame comprising a plurality of mounting plates that extend outwardly from the frame behind the one wall, the frame being mounted to framing members behind the one wall by way of the plurality of mounting plates.

5. The retractable shower floor system of claim 1, wherein the drive mechanism is coupled to the upper pulley in order to drive the upper pulley.

6. The retractable shower floor system of claim 1, wherein the motor is controlled by a remote control.

7. The retractable shower floor system of claim 1, wherein the retractable shower floor has a rough, slip-resistant surface.

8. A retractable shower floor system, comprising:

a retractable shower floor that is convertible between an operating position in which the retractable shower floor is horizontal and a retracted position in which the retractable shower floor is vertical, wherein the retractable shower floor in the operating position spans across a bathtub and facilitates support of at least one person and drainage of water through the retractable shower floor and into the bathtub underneath, and the retractable shower floor in the retracted position facilitates unobstructed use of the bathtub, wherein the retractable shower floor comprises a plurality of elongated elements spanning a width of the bathtub; and a motor coupled to a drive mechanism that is configured to transfer motion of the motor to a looped drive belt spanning an upper pulley and a lower pulley, the retractable shower floor comprising an attachment to the looped drive belt, the attachment comprising a bar extending outwardly from the looped drive belt in a longitudinal direction and attached to the retractable shower floor at substantially a midpoint of a width of an upper one of the plurality of elongated elements, wherein motion of the looped drive belt in a first direction causes the retractable shower floor to retract toward the retracted position, and motion of the looped drive belt in a second direction causes the retractable shower floor to extend toward the operating position.

9. The retractable shower floor system of claim 8, wherein the bathtub is installed to rest upon a floor level in a structure.

10. The retractable shower floor system of claim 8, wherein the retractable shower floor is configured to be retracted upwards to cover at least a portion of a wall of a bathtub surround in the retracted position.

11. The retractable shower floor system of claim 8, wherein the retractable shower floor is configured to be retracted through an opening in a wall of a bathtub surround so that the retractable shower floor is behind the wall in the retracted position.

12. The retractable shower floor system of claim 8, further comprising at least one track in a horizontal plane above or on a top of the bathtub that supports elements of the retractable shower floor in the operating position.

13. The retractable shower floor system of claim 8, wherein the plurality of elongated elements are formed of a rigid material configured to support a weight of the at least one person without permanent deformation.

14. The retractable shower floor system of claim 8, wherein a spacing between the plurality of elongated elements facilitates the drainage of water through the retractable shower floor and into the bathtub underneath.

15. The retractable shower floor system of claim 8, wherein adjacent ones of the plurality of elongated elements are connected by at least one respective hinge.

16. The retractable shower floor system of claim 8, wherein individual ones of the plurality of elongated elements has a first respective roller configured to move along a first track and a second respective roller configured to move along a second track.

17. A method for using a convertible tub/shower, the method comprising:

moving a retractable shower floor from a retracted position in which the retractable shower floor is vertical to an operating position in which the retractable shower floor is horizontal, wherein the retractable shower floor covers a top of a bathtub in the operating position, wherein the retractable shower floor comprises a plurality of elongated elements spanning a width of the bathtub, wherein moving the retractable shower floor further comprises actuating a motor coupled to a drive mechanism that transfer motion of the motor to a looped drive belt spanning an upper pulley and a lower pulley, the retractable shower floor comprises an attachment to the looped drive belt, the attachment comprising a bar extending outwardly from the looped drive belt in a longitudinal direction and attached to the retractable shower floor at substantially a midpoint of a width of an upper one of the plurality of elongated elements, and motion of the looped drive belt in a first direction causes the retractable shower floor to extend toward the operating position; and operating a shower head fixture to allow water emitted by the shower head fixture to pass through the retractable shower floor into the bathtub underneath.

18. The method of claim 17, further comprising moving the retractable shower floor from the operating position to the retracted position, wherein the retractable shower floor is retracted through an opening in a surround of the bathtub so that the retractable shower floor in the retracted position is contained behind the surround of the bathtub, and motion of the looped drive belt in a second direction causes the retractable shower floor to retract toward the retracted position.

19. The method of claim 17, wherein moving the retractable shower floor from the retracted position to the operating position further comprises activating a switch causing the motor to move the retractable shower floor along a pair of tracks out from behind a surround of the bathtub through an opening in the surround.

* * * * *